United States Patent [19]

Lewis et al.

[11] 4,355,495

[45] Oct. 26, 1982

[54] METHOD AND APPARATUS FOR HANDLING PACKAGING CONTAINERS

[75] Inventors: Roy D. Lewis, Farjestaden; Bernt V. Borg, Kalmar, both of Sweden

[73] Assignee: Norden Packaging Machinery Aktiebolag, Sweden

[21] Appl. No.: 112,546

[22] Filed: Jan. 16, 1980

[30] Foreign Application Priority Data

Jan. 17, 1979 [SE] Sweden ..... 7900398

[51] Int. Cl.[3] ..... B65B 43/00; B65B 3/12; B65B 3/14

[52] U.S. Cl. ..... 53/579; 53/282; 53/331.5; 29/773; 29/778; 29/794; 141/2; 141/27

[58] Field of Search ..... 53/470, 473, 282, 284, 53/452, 471, 490, 558, 579, 331.5; 141/27, 2, 327, 326; 29/777, 778, 773, 776, 794

[56] References Cited

U.S. PATENT DOCUMENTS

| | | | |
|---|---|---|---|
| 2,393,217 | 1/1946 | Brewton | 141/27 X |
| 2,698,478 | 1/1955 | Heisterkamp et al. | 29/777 |
| 2,925,100 | 2/1960 | Senger | 141/27 |
| 3,236,268 | 2/1966 | Simpson | 141/27 |
| 3,270,483 | 9/1966 | Smoyer et al. | 53/320 X |
| 3,388,528 | 6/1968 | Croall et al. | 53/282 X |
| 3,527,015 | 9/1970 | Aronson et al. | 53/282 X |
| 3,708,945 | 1/1973 | Klettke | 53/282 X |
| 3,731,453 | 5/1973 | Porteous | 53/471 |
| 3,788,035 | 1/1974 | Geisel | 53/282 |
| 3,853,157 | 12/1974 | Madaio | 141/2 |
| 3,981,119 | 9/1976 | Schultz | 53/470 |
| 4,243,080 | 1/1981 | Choksi et al. | 141/2 |

*Primary Examiner*—Horace M. Culver

*Attorney, Agent, or Firm*—Lerner, David, Littenberg & Samuel

[57] ABSTRACT

A method and apparatus for handling of containers of the type having a sleeve with one open end and a substantially closed end having an opening therein, and having a displaceable plunger sealingly engaging the inside wall of the sleeve and being displaceable along the axis thereof between the open and closed ends. In accordance with both the method and apparatus, the plunger is assembled in the sleeve and is displaced toward the closed end thereof having the opening therethrough, and the container is then filled with a suitable filling material through the opening simultaneously as the displaceable plunger is moved away from the opening, thereby allowing the material to be injected freely into the container without having to evacuate air therefrom. Preferably, a plurality of plungers are assembled within the sleeves, the plungers displaced towards the closed end having the opening of the sleeves, and then filled with material and sealed as the individual components are moved by means of a conveyor past different processing stations.

13 Claims, 9 Drawing Figures

METHOD AND APPARATUS FOR HANDLING PACKAGING CONTAINERS

BACKGROUND OF THE INVENTION

The present invention generally relates to a method and apparatus for handling packaging containers, and more particularly containers of the type having an opening in one end thereof and a displaceable member adapted for movement toward and away from the opening. The opening serves as a means for dispensing of material from the container by moving the plunger toward the opening.

Recently, there has been developed a container which basically comprises a sleeve provided with a closed end having an opening therein and including a displaceable plunger inside the sleeve and sealing against the inside wall thereof, the plunger being adapted for movement towards and away from the end having the opening. The particular closed end surface of the sleeve having the opening may for example comprise a conical shaped end surface having a nipple upstanding therefrom through which the opening extends. A closure member such as a cap may also be provided for sealing the opening in the closed end of the container. Such a container construction has been of recent interest, particularly from the point of view of cost of manufacture and distribution in comparison to conventional tubular containers. For instance, such containers have a sufficient stability and are rigid enough for being marketed without any outer cardboard container or box therefor. Further, such containers may comprise a sleeve which is cylindrical without having an longitudinal seam therealong which is advantageous in that it permits printing by a relatively simple means and further eliminates the need for orienting the print relative to the longitudinal seam.

Aspects of the type mentioned above of course imply that the container construction as such has particular interest. However, this is not enough in terms of assemblying and manufacturing filled containers. Instead, mechanical handling facilities which might be used for such assemblying, filling and sealing must also be considered. In this regard, if conventional machinery or equipment is used for handling of such containers as with which the present invention is concerned, certain problems are encountered. For example, conventional machinery is generally of a construction such that it operates in terms of filling and sealing on the bottom ends of the tubes or containers. While equipment may be known for filling of containers, for example medical capsules or the like, from the top end, it is to be noted that such container types generally have a relatively large filling opening or a container wall material of such a flexibility that a separate air evacuation device may be easily inserted through the filling opening between the filling pipe and the wall of the opening to accomplish the desired filling thereof.

However, in terms of the types of containers in connection with which the present invention is concerned, one problem which is encountered results from the fact that relatively rigid containers are used in which the bottom thereof is sealed by means of a plunger or piston provided with a sealing flange and which plunger or piston is displaceable inside the container, as well as the fact that such containers often have a relatively small filling/pouring opening for the receipt into and dispensing of material from such opening. In this instance, when it is desired to fill the container through the top thereof, separate air evacuation devices are generally not capable of being inserted into the fill opening; yet, in order to accomplish an optimum and quick filling of such containers, it is necessary that air not be trapped in the container during the filling operation.

SUMMARY OF THE INVENTION

Such an optimum and quick filling of containers of the type having an opening in one end thereof and including a displaceable plunger therein for movement towards and away from the opening is accomplished with the method and apparatus of the present invention. More particularly, in accordance with the method of the present invention for handling such containers, the displaceable member is initially positioned adjacent the opening in the container, and then the container is filled with material through the opening simultaneously as the displaceable member is moved away from the opening. This has the advantage that during the filling operation no air will be trapped inside the container; rather, the air is evacuated initially by displacement of the plunger towards and adjacent the opening and the plunger is moved away from the opening only during the filling of the container. Additionally, this provides the advantage that the displaceable member which sealingly engages the inside walls of the container is "trimmed" to a sealing position during the displacement of the plunger both during movement towards the opening as well as during the movement away from the opening.

In accordance with the apparatus of the present invention, positioning means are provided for positioning of the displaceable member in the container adjacent the opening thereof, and filling means are provided for filling the containers with material through the opening and for simultaneously moving the displaceable member in a direction away from the opening as the container is filled. In the preferred embodiment, this filling means comprises means for injecting material into the opening which thereby causes the displaceable member to simultaneously move away from the opening in the container body by virtue of the volume of the material injected into the container.

Also in accordance with the method and apparatus of the present invention for handling of containers, the various parts of the container, namely the sleeve having a closed end surface with the filling/dispensing opening therein and the displaceable plunger, as well as a sealing cap if one is provided, are assembled and the container filled and sealed at a number of processing stations located along the path of movement of an endless conveyor means which carries the various components or parts of the container. Preferably, the endless conveyor is provided with a plurality of sockets thereon which are indexed or displaced past the various processing stations. For instance, in the preferred embodiment, the first processing station may include assemblying means which serve to first insert a plunger element into the socket and which then inserts a sleeve into the socket in a manner to receive the plunger in the open end or bottom thereof. The second processing station may then include means for holding the sleeve in the socket while pushing the plunger towards the closed end surface of the sleeve having the opening therein to position the plunger adjacent the opening. The next processing station located downstream of the first and second stations may comprise injecting means for injecting material through the opening into the sleeve, thereby causing the plunger to move away from the opening depending on the volume of the material injected into the container. Further processing stations may be provided for closing the opening, such as by threading a cap member onto an upstanding nipple on the closed end surfce of the sleeve, and for removing the containers from the conveyor.

In the preferred embodiment, the conveyor preferably comprises a series of interconnected plates having openings therein for replaceable accommodation of sockets thereon. Further, a supporting structure may be provided which includes a housing or cover for covering the portion of the endless conveyor which is remote from the processing stations so as not to interfere with laminar flow of sterile air which flows around the operative portion of the conveyor. Still further, individual components of the container may be supplied by a vibrator supply means which includes support members supported on the supporting structure and insulating means for the support members for insulating the support members from the support structure. This insulating means for example may comprise elastic members arranged between the support members and the support structure.

These and further features and characteristics of the present invention will be apparent from the following detailed description in which reference is made to the enclosed drawings which illustrate a preferred embodiment of the present invention.

DETAILED DESCRIPTION OF THE PREFERRED EMBODIMENT

Figure 1:
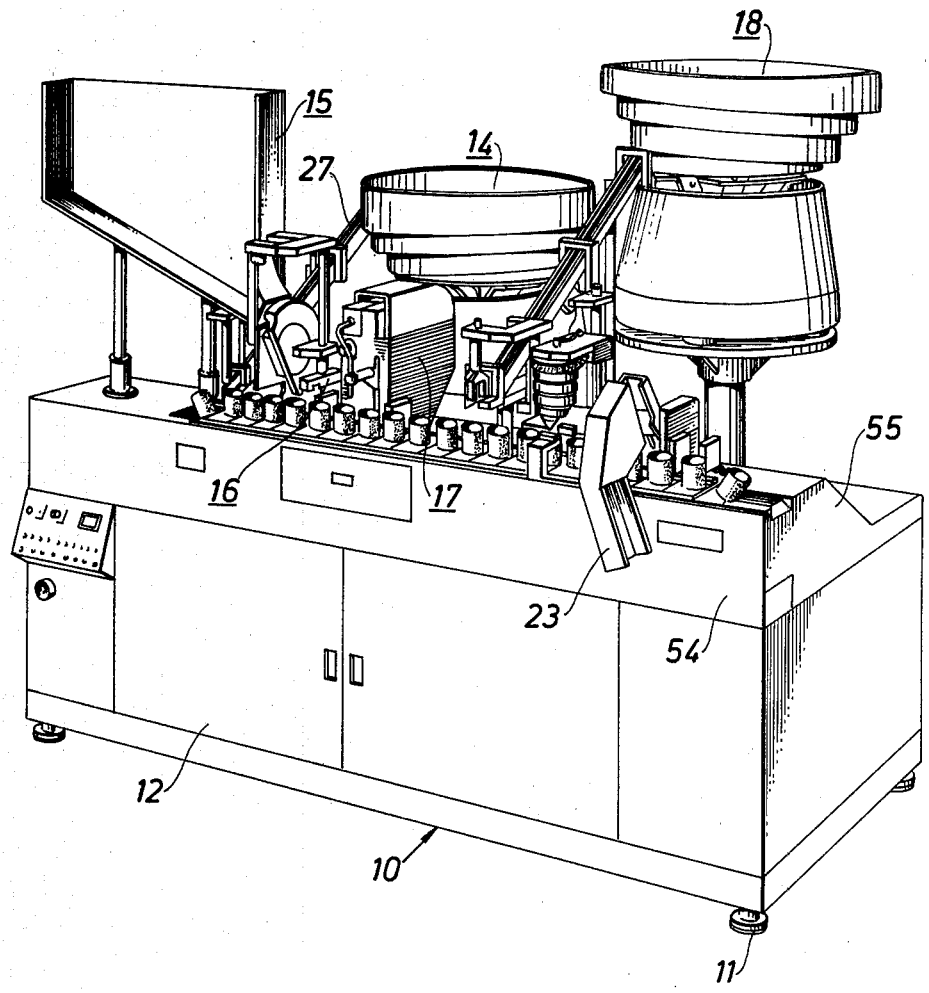
FIG. 1 is a schematic perspective view showing an apparatus for handling packaging containers in accordance with the method and apparatus of the present invention.
Figure 9:
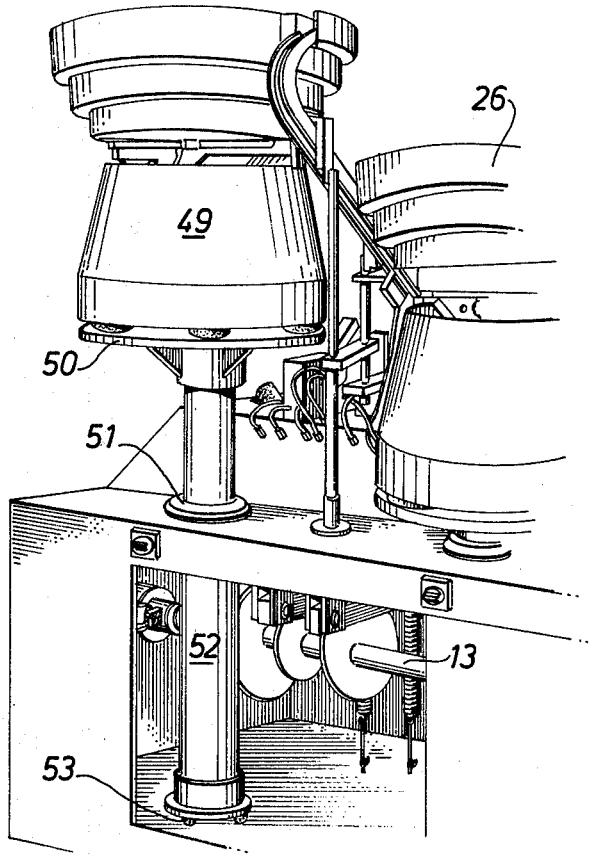
FIG. 9 is a rear perspective view of a portion of the apparatus shown in FIG. 1, illustrating a vibrator supply means and support therefor for supplying plungers and/or cap members for the containers.

Referring now to the drawings wherein like reference characters represent like elements, there is shown in FIG. 1 a machine or apparatus 10 in accordance with the present invention. The machine 10 is adapted to rest by means of feet 11 on a horizontal surface. The drive motor of the machine 10 and the driving mechanisms at the several processing stations therein are hidden behind cover plates and lids 12 as shown in FIG. 1. In the preferred embodiment, the driving is accomplished from a single cam shaft which extends in the longitudinal direction of the machine 10, a part 13 of such cam shaft being shown partially in FIG. 9. For the remainder of the power transfer and synchronization which is carried out by different link and arm mechanisms or the like, the mechanisms have merely been shown in the drawings to the extent which has been deemed necessary for a full understanding of the invention. In this regard, it should be noted that such power transfer and synchronization systems are well known in the art, once the particular desired function to be performed at the various processing stations by the various elements is known.

Figure 2:
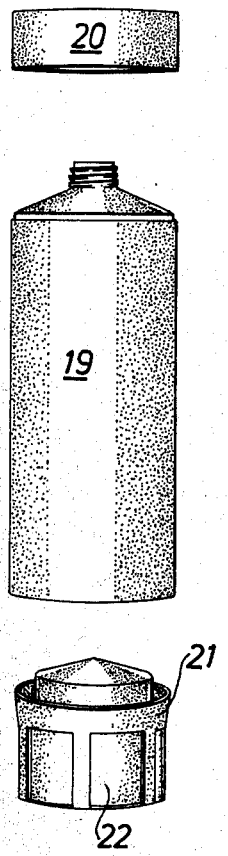
FIG. 2 is an exploded view showing the component parts of the container to be handled in accordance with the method and apparatus of the present invention.

As best seen in FIG. 1, the apparatus 10 includes a number of processing stations 14–18 for handling of a packaging container of the type which is depicted schematically in exploded view in FIG. 2. Such a container comprises generally a container body or sleeve 19, which in FIG. 2 is of a generally cylindrical shape, having a closed upper end provided with an opening therethrough and having a generally open bottom end for receiving a displaceable member or plunger 22. In the embodiment shown in FIG. 2, the plunger 22 is provided with a sealing flange 21. Also, a suitable closure member, such as for example a threaded cap 20, may also be provided for threading onto a threaded nipple at the upper closed end of the container sleeve 19. In this instance, the opening of the container extends through the nipple and the cap 20 serves to sealingly close the opening after it has been filled with suitable filling material. It is through this opening that the container sleeve 19 is filled and that material may be dispensed from the container.

Figure 8:
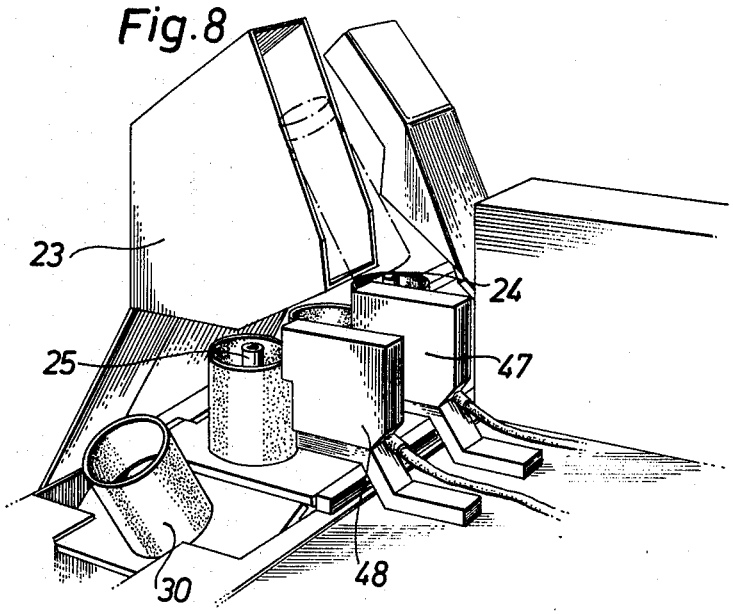
FIG. 8 is a perspective view of the output end of the apparatus shown in FIG. 1.

In FIG. 1, the processing station 14 includes a plunger storing and plunger output device, the processing station 15 includes a sleeve storing and sleeve output device, and the station 16 includes a plunger inserting device for moving the plunger 22 towards the upper closed end of the container sleeve 19. The processing station 17 comprises a filling station and the processing station 18 comprises a sealing closure storing and output station. At the right hand end of the machine as shown in FIG. 1, there is provided a removal station, or more precisely two such stations, one for defective containers and the other one for properly sealed and filled containers. The output or removal station for defective containers is located adjacent an output chute 23 which in turn is arranged in front of, in the direction of movement of the conveyor 29, the output or removal station for correctly filled and sealed containers which is more fully shown in FIG. 8. As can be seen in FIG. 8, ejectors 24 and 25 are provided for the output or removal stations for ejecting containers from the conveyor 29.

Figure 3:
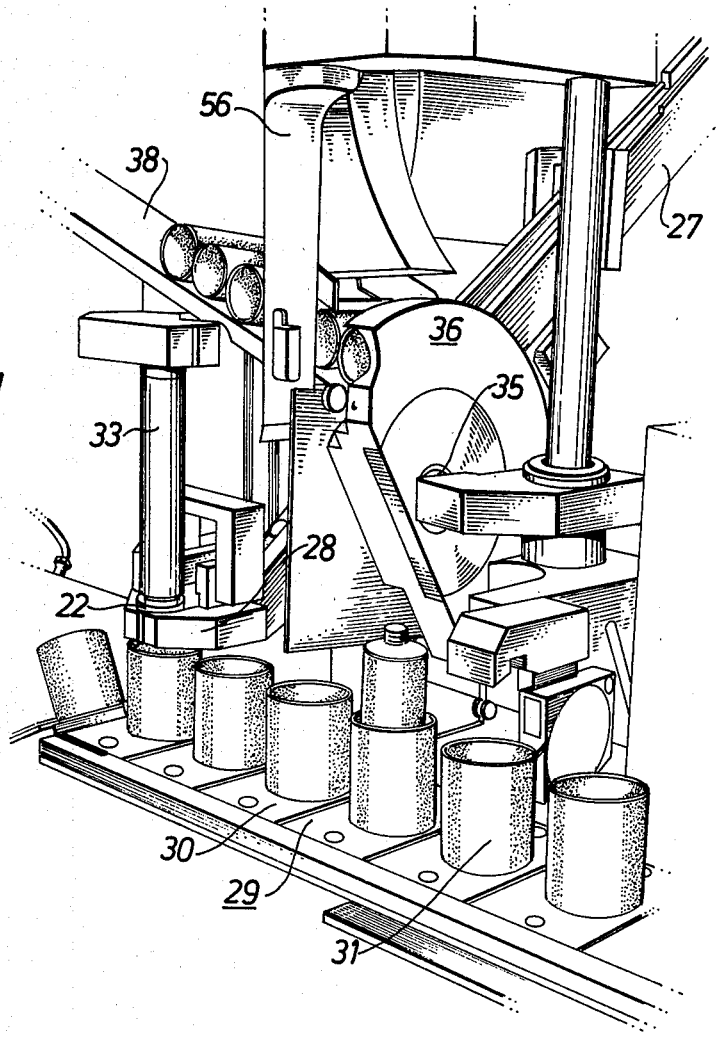
FIG. 3 is an enlarged view of a portion of the apparatus shown in FIG. 1 illustrating the mechanism for inserting container sleeves into sockets on the conveyor.
Figure 5:
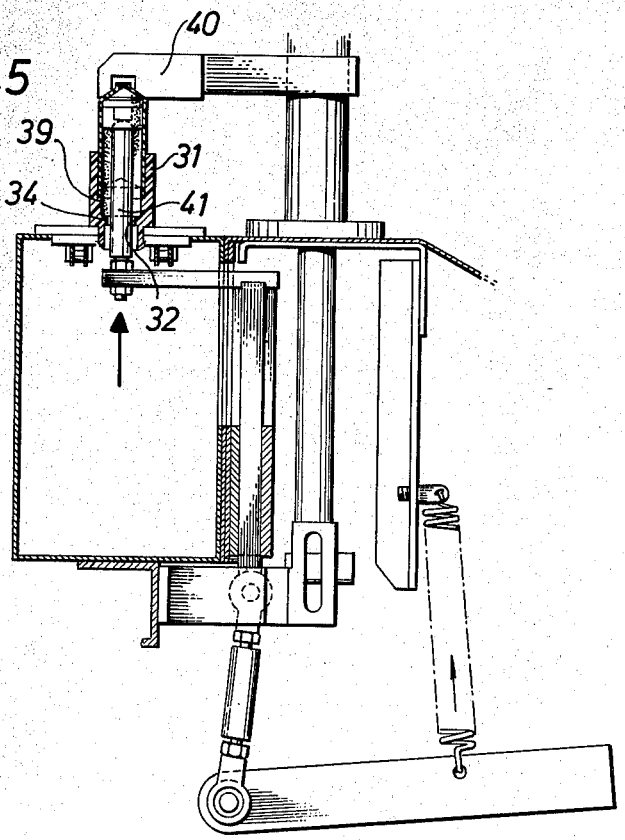
FIG. 5 is a schematic elevational view illustrating the mechanism for inserting plungers into the sleeves of the containers and positioning the plungers adjacent the opening in the closed end of the sleeves.

At the first processing station 14 in the apparatus 10, the plunger storing and output device serves to supply plungers 22 for placement into sockets 31 on the conveyor 29. More particularly, the storing part at this station 14 comprises a vibrator bowl 26 (best seen FIG. 9) of a conventional type which, by the oscillation in the vertical direction thereof, orients and supplies plungers 22 in a proper position to an inclined chute 27. As best seen in FIG. 3, the chute 27 terminates in a stop member 28 directly above the beginning of an upper horizontal part of the endless conveyor 29. The conveyor 29 preferably consists of pivotally or hinged interconnected plates 30 of metal or other suitable material, for instance, "DELRIN". Each one of the plates 30 is provided with a central hole for replaceably receiving a cup shaped socket member 31 for carrying the packaging containers which are to be handled by the apparatus 10. As can best be seen in FIG. 5, each of the socket members 31 is provided with a hole 32 in the bottom thereof which is arranged for a subsequent or succeeding handling operation as the container elements are moved past the various processing stations on the conveyor 29. The distance between adjacent sockets 31 represents a specified pitch and corresponds to an index step of the conveyor 29. This indexing movement is obtained by conventional means, known per se, and, as with the remaining portion of the drive means, is obtained by means of a main motor (not shown) of the machine 10. This indexing thus determines the distance which is possible between the processing stations 14–18, and such distances between the processing stations 14–18 should correspond to a multiple of such pitch.

When a plunger 22 is at the position of the stop member 28, and a socket member 31 has been indexed forward to a position directly below the stop member 28, an insertion rod 33 is activated for vertical movement downwards by a link mechanism controlled by the main cam shaft (not shown) of the machine 10. This rod 33 thus serves to place the plunger 22 positively in a corresponding socket 31 so that the plunger 22 will rest against a circumferential shoulder 34 (see FIG. 5) in the socket 31. After this placement of a plunger 22 in the socket 31, the rod 33 is again guided upwards and the conveyor 29 is indexed forward one pitch.

Figure 4:
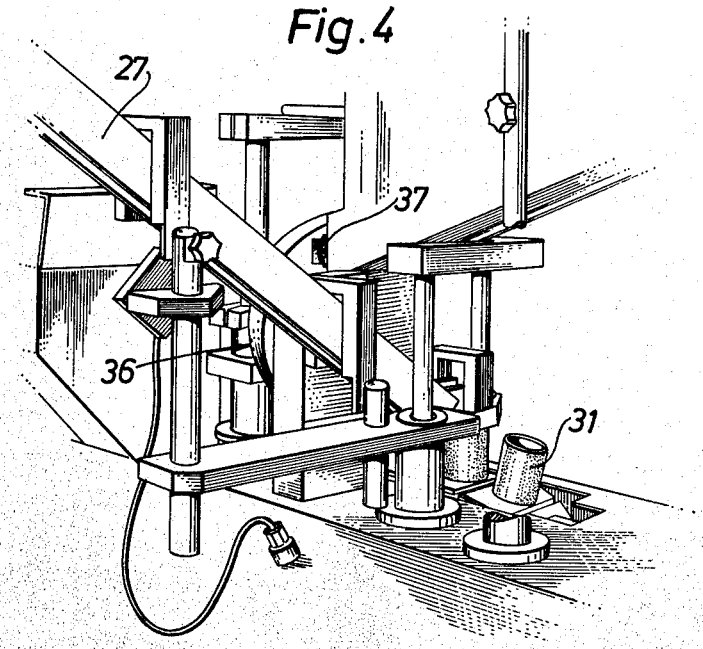
FIG. 4 is a perspective view from the opposite side of the apparatus from that shown in FIG. 3.

When the particular socket member 31 having the plunger 22 therein finally reaches the next processing station 15, i.e. the sleeve storage and output station, a sleeve 19 is inserted into the socket 31 by means of an insertion wheel 36 which is rotatably mounted on a shaft 35. The insertion wheel 36 is provided with a dog groove 37 (see FIG. 4) formed therein. When the wheel 36 assumes the position shown in FIG. 3, the dog groove 37 is positively supplied with a sleeve 19 due to the inclination of the sleeve storage bottom 38. When a socket member 31 having a plunger 22 therein is located in the path of rotation of the dog groove 37, the insertion wheel 36, under the control of the cam shaft of the machine 10, is rotated in a counterclockwise direction of rotation about the shaft 35, as viewed in FIG. 3, to positively insert the sleeve 19 into the socket member 31 under the action of a push down rod 56 so that the lower edge of the sleeve 19 rests on a second circumferential shoulder 39 (see FIG. 5) in the socket member 31. During this operation, the plunger 22 is inserted into the open lower end of the sleeve 19 to be positioned at the lower or bottom end of the cylinder 19. Thereafter, the insertion wheel 36 is rotated in the opposite direction, i.e., clockwise as shown in FIG. 3, and returns, still under the control of the cam shaft, to the start position thereof according to FIG. 3 in order to reassume the movement thereof after further indexing of the conveyor 29. The conveyor 29 is then indexed forward.

Figure 6:
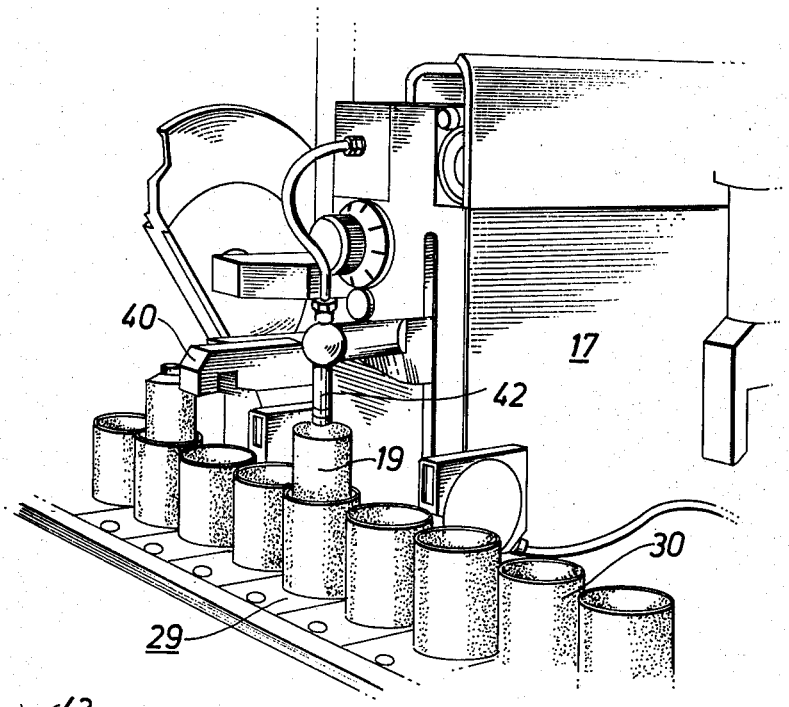
FIG. 6 is a perspective view of the filling station and adjacent elements of the apparatus shown in FIG. 1.
Figure 7:
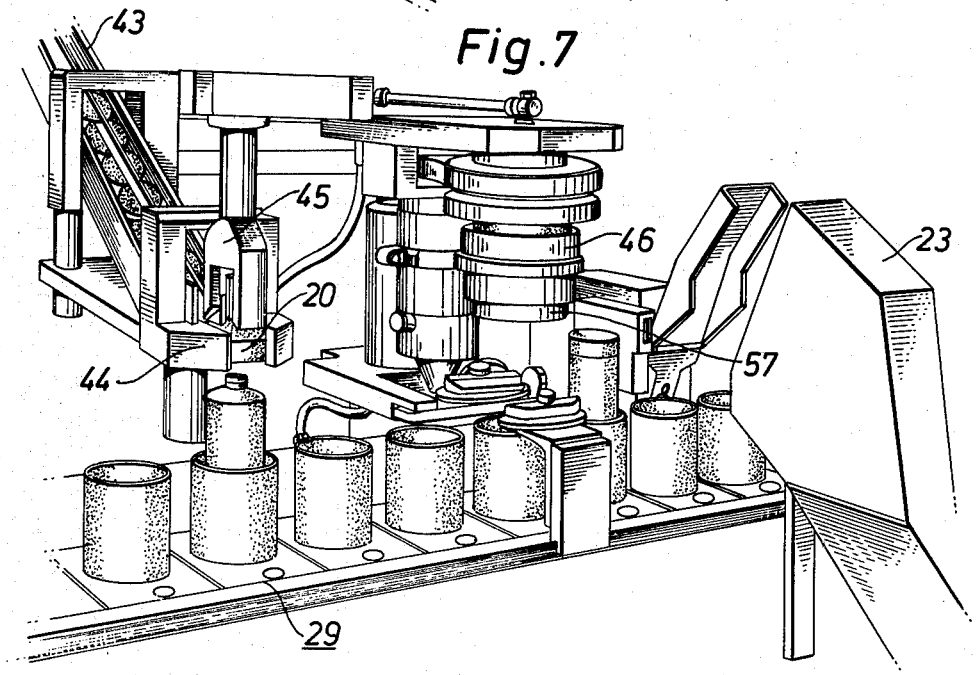
FIG. 7 is a perspective view illustrating the sealing station and mechanism for mounting closure caps onto threaded nipples of the container sleeves.

At the next processing station in the machine 10, namely the plunger insertion station 16, the plunger 22 is pushed upwardly into the sleeve 19 towards the closed end of the sleeve 19 to be in a position adjacent the opening in the closed upper end of the sleeve 19. As can best be seen in FIGS. 1 and 6, at this station 16, there is provided an upper abutment member 40 for maintaining the sleeve 19 in position in the socket member 31. Also, as can best be seen in FIG. 5, the plunger 22 is vertically displaced upwardly by means of a rod 41 which passes through the hole 32 in the socket member 31, the movement of the rod 41 being controlled from the cam shaft of the machine 10 by a suitable link arrangement for upward and downward movement in timed relationship to the indexing. The stroke of the rod 41 may be adjusted so that the plunger 22 is pushed upwardly toward the upper closed end of the sleeve 19 so as to be adjacent the opening thereof.

After the plunger 22 has been displaced to be adjacent the opening in the sleeve 19, the sleeve 19 and plunger 22 are indexed forward to the filling station 17 by indexing of the conveyor 29. The filling station 17 basically consists of a volume dosing device which may be of the type described in copending Application Ser. No. 112,547, entitled "Controllable Volume Dosing Device" in the names of Lewis and Borg and filed on even date herewith, which copending Application Ser. No. 112,547, is hereby incorporated by reference. In this connection, it is sufficient to note that at the filling station 17 there is provided a vertically movable nozzle 42 which, under the action of the cam shaft, is vertically movable to be inserted into the opening in the upper end of the sleeve 19. When the nozzle 42 is opened and the pressure is built up in the dosage chamber of the volume dosing device, the plunger 22 will be displaced towards the bottom position thereof during the simultaneously filling of the interior of the sleeve 19. The volume of the dosing material injected into the sleeve 19 may be adjusted so as to control the displacement of the plunger 22 downwardly within the sleeve 19 to a proper finished position. Preferably the finished position is one in which no part of the plunger 22 extends outside of the sleeve 19.

Once the container has been filled, the conveyor 29 is indexed forwardly toward the next station, namely the closure station 18 which is very similar in appearance and function to station 14. In the same manner as at station 14, there is provided an inclined chute 43 at the station 18 which acts as a termination point having a stop 44. At this stop 44, end closure members 20, one by one, are taken by means of a gripper mechanism 45 and placed onto the threaded nipple portion at the upper end of the sleeve 19. In the same manner as the operative elements at the other stations, the gripper 45 is controlled in timed relationship to the index movement of the conveyor 29 for accomplishing this function. By means of a chuck arrangement 57 driven by a drive motor 46, the end closure member 20 is then threadably secured to the threaded nipple of sleeve 19 to complete closing and sealing of the filled container. In the embodiment shown, the sealing station 18 thus comprises a pair of substations—one for placing of a cap or closure member 20 onto the threaded nipple portion and the other of which serves to rotate the closure member 20 to screw same onto the sleeve 19.

The finished, filled and sealed container is now ready to be discharged from the machine 10. However, before this occurs, a photocell (not shown) senses if the container is complete—i.e., whether all the component parts thereof have been provided. If this is not the case, the container or parts of the container are ejected by means of ejector 24 into chute 23. A sensor 47 is provided in this regard which guarantees that the rejection of a faulty container has actually taken place (see FIG. 8). If the container is complete, and has been properly filled and sealed, it will be indexed past the reject chute 23 and ejected by means of ejector 25 from the conveyor 29. It is then delivered to an appropriate storage device, for instance a transport belt or storage container. A sensor 48 is provided which serves as a security guard to guarantee that a container has actually been ejected.

Thus, it will be appreciated that in accordance with the present invention, the various component parts of the container, namely the plunger 22 and sleeve 19, are first assembled in a proper fashion with the plunger 22 being inserted into the open end of the sleeve 19, and then the plunger 22 is positioned towards the closed end of the container sleeve 19 adjacent the opening thereof. During this movement, air trapped within the container is ejected through the opening with the plunger 22 serving to be trimmed or sealed during this movement toward the closed end of the sleeve 19. Once the plunger 22 is in the proper position adjacent the open end of the sleeve 19, the assembled container is delivered to the filling station 17 which injects filling material into the sleeve body 19 under pressure, which thereby forces the plunger 22 downwardly toward the open end of the sleeve 19. It will be appreciated that very little air will be trapped within the sleeve 19 since the movement of the plunger 22 towards the closed end has served to expel most of such air which might otherwise be trapped when material is injected into the sleeve 19. Thus, as material is injected into the sleeve 19 and the plunger 22 moved downwardly, it will not be necessary to utilize a separate air evacuation system to remove trapped air. Finally, after the container has been filled, the container is indexed forwardly to receive a closure cap 20 and then discharged from the conveyor 29.

As noted above, one of the component pieces of machinery in the apparatus 10 comprises a vibrator feeder mechanism which is generally of a conventional type. According to another aspect of the present invention, the mechanical support for such a vibrator mechanism has been improved. Specifically, as appears in FIG. 9, the vibrator 49, which has been shown as a representative example, is supported by a platform 50 which in turn is supported by a divided telescope shaft 52. In order to insulate the support device 50, 52 from the remaining support structure, there has been provided a sturdy O-ring 51 inserted at a bushing in the machine's support structure. In a similar manner, the foot of the telescope shaft 52 is insulated from the machine support structure by sturdy rubber cushions 53. Such an arrangement is most advantageous in that it insulates the vibrating or oscillating machinery from the remaining support structure for the various processing stations 14–18 which might otherwise damage or affect proper handling of the containers.

It will be further noted that the apparatus 10 is provided with a flow housing which surrounds the conveyor path which does not move past the various processing stations 14–18. That is, if the conveyor 29 is considered as moving along a closed path of travel or movement, one portion of the path moves past the various processing stations 14–18 and the remaining portion of the path is remote from the processing stations 14–18. In accordance with another aspect of the present invention, this remaining portion of the conveyor path, ie. that portion of the path at which the various processing stations 14–18 are not located, is completely enclosed within a housing or cover. Specifically, on both sides of machine 10, this housing forms pronounced partition walls 54, 55 (see FIG. 1) which walls 54, 55 do not interfere with the laminar flow of sterile air or other medium around the apparatus 10. This is particularly advantageous as the various machinery and elements of the apparatus 10, other than those which are at the processing stations 14–18 or which must move past the processing stations 14–18, do not adversely affect the sterile filling of the containers. Thus, only portions of the conveyor 29, in particular not the drive mechanism or machinery therefor, move past the various processing stations 14–18 which are arranged in a sterile atmosphere for proper sterile filling.

It of course should be appreciated that although particular apparatus 10 has been described in terms of its construction and function with reference to a single individual packaging container, it of course should be realized that in actual practice the various processing stations 14–18 operate in parallel and simultaneously with one another on a plurality of corresponding package containers, the same in number as the number of processing stations 14–18, in order to provide for a quick and efficient system for assemblying, filling and closing such containers. That is, although the operation of the machine 10 has been described with reference to only a single individual container as it is indexed past the various processing stations 14–18, the various processing stations 14–18 are able to operate in parallel and simultaneously by virtue of the indexing of the conveyor 29 which serves to index simultaneously a plurality of such containers, in various stages of assembly, filling and sealing, into position at the various respective subsequent processing stations to be operated on or handled simultaneously. Also, in the embodiment disclosed and described hereinabove, only a single operation has been performed on a particular individual packaging container at each processing stations 14–18. It of course is possible however to modify the various processing stations 14–18 so that several packaging containers could be handled simultaneously at one and the same station.

While the preferred embodiment of the present invention has been shown and described, it will be understood that such is merely illustrative and that changes may be made without departing from the scope of the invention as claimed.

What is claimed is:

1. An apparatus for handling of containers in which each of said containers includes a sleeve having a closed end surface having an opening extending therethrough and an open end displaced from said closed end surface, and an associated displaceable plunger for sealingly engaging the inner sidewall of said sleeve and being displaceable along the length of said sleeve between said open end and said closed end surface, said apparatus comprising:

an endless conveyor having at least one socket thereon and being operable to move said at least one socket along a path of movement;

first insertion means for inserting a plunger into said at least one socket on said conveyor means as said at least one socket moves therepast, said first insertion means being located at a first location along said path of movement;

second insertion means for inserting a sleeve into said one socket in a manner to receive said plunger in said open end thereof, said second insertion means being located at a second location displaced from said first location along said path of movement;

displacing means for displacing said plunger towards said closed end surface of said sleeve after said plunger and said sleeve have been inserted into said at least one socket on said conveyor means, said displacing means being located at a third location displaced from said first and second locations along said path of movement; and filling means for filling said container with a material through said opening in said closed end surface of said sleeve and for simultaneously moving said plunger in a direction away from said opening of said closed end surface towards said open end of said sleeve as said container is filled through said opening, said filling means being located at a fourth location displaced from said first, second and third locations along said path of movement.

2. The apparatus of claim 1 further including sealing means for sealing said opening in said sleeve after said container has been filled with material.

3. The apparatus of claim 1 wherein said displacing means comprises holding and pushing means at said third location for holding said sleeve in said at least one socket and for pushing said plunger towards said closed end surface of said sleeve.

4. The apparatus of claim 3 wherein said filling means comprises injecting means at said fourth location for injecting material into said opening in said sleeve to thereby move said plunger towards said open end of said sleeve.

5. The apparatus of claim 4 wherein said sealing means comprises closure means at a fifth location spaced from said first, second, third and fourth locations for closing said opening of said sleeve.

6. The apparatus of claim 5 in which said closed end surface of said sleeve includes a threaded nipple having said opening therein, and wherein said closure means comprises cap placement means for placing a cap on said threaded nipple and threading means for threading said cap onto said threaded nipple.

7. The apparatus of claim 5 further including removing means at a sixth location spaced from said first, second, third, fourth and fifth locations for removing said containers from said conveyor means.

8. The apparatus of claim 7 further including a common drive shaft having a plurality of cams thereon for controlling said first and second insertion means, said holding and pushing means, said injecting means, said closure means and said removal means as said one socket on said conveyor means moves past said first, second, third, fourth, fifth and sixth locations.

9. The apparatus of claim 8 further including indexing means associated with said common drive shaft for indexing said socket past said first, second, third, fourth, fifth and sixth locations.

10. The apparatus of claim 9 wherein said conveyor means comprises a series of interconnected hinged plate members each having openings formed therein for removably receiving a plurality of sockets for a plurality of said plungers and sleeves.

11. The apparatus of claim 10 further including a support structure for supporting said first insertion means, said second insertion means, said holding and pushing means, said injecting means, said closure means and said removal means at said first, second, third, fourth, fifth and sixth locations respectively, and for supporting said conveyor means for movement along a conveyor path comprised of a first path portion at which said first, second, third, fourth, fifth and sixth locations are located and a second path portion, and further including a housing cover for covering said second path portion so as not to interfere with laminar air flow around said sockets on said conveyor means.

12. The apparatus of claim 2 wherein said conveyor means includes a plurality of said sockets thereon, further including a support structure for supporting said conveyor means, said assemblying means, said displacing means, said filling means and said sealing means, and further including vibrator supply means for supplying plungers one by one, to said sockets as said conveyor means moves past said vibrator supply means, said vibrator supply means including support members supported by said support structure and insulating means for said support members for insulating said support members from said support structure.

13. The apparatus of claim 12 wherein said insulating means comprises elastic members arranged between said support members and said support structure.

* * * * *

UNITED STATES PATENT AND TRADEMARK OFFICE

CERTIFICATE OF CORRECTION

PATENT NO. : 4,355,495

DATED : October 26, 1982

INVENTOR(S) : Lewis, et al

It is certified that error appears in the above-identified patent and that said Letters Patent are hereby corrected as shown below:

Column 9, line 21, "1" should read --2--.

Signed and Sealed this

*Twenty-second* Day of *February 1983*

[SEAL]

*Attest:*

GERALD J. MOSSINGHOFF

*Attesting Officer*

*Commissioner of Patents and Trademarks*